US010288273B2

(12) United States Patent
Zhou et al.

(10) Patent No.: US 10,288,273 B2
(45) Date of Patent: May 14, 2019

(54) WIRE CLAMPING-TYPE CONNECTION STRUCTURE BETWEEN POWER SUPPLY AND LIGHT SOURCE BOARD

(71) Applicant: Ningbo Yamao Optoelectronics Co., Ltd., Xikou Ningbo, Zhejiang (CN)

(72) Inventors: Yinyong Zhou, Zhejiang (CN); Qili Xu, Zhejiang (CN); Hu Fang, Zhejiang (CN)

(73) Assignee: NINGBO YAMAO OPTOELECTRONICS CO., LTD., Zhenjiang (CN)

( * ) Notice: Subject to any disclaimer, the term of this patent is extended or adjusted under 35 U.S.C. 154(b) by 0 days.

(21) Appl. No.: 15/710,188

(22) Filed: Sep. 20, 2017

(65) Prior Publication Data

US 2018/0202641 A1 Jul. 19, 2018

(30) Foreign Application Priority Data

Jan. 13, 2017 (CN) ..... 2017 1 0026232

(51) Int. Cl.

| | |
|---|---|
| ***F21V 23/00*** | (2015.01) |
| ***F21V 23/06*** | (2006.01) |
| *F21Y 115/10* | (2016.01) |
| *F21Y 105/10* | (2016.01) |

(52) U.S. Cl.

CPC ..... *F21V 23/06* (2013.01); *F21V 23/002* (2013.01); *F21V 23/006* (2013.01); *F21Y 2105/10* (2016.08); *F21Y 2115/10* (2016.08)

(58) Field of Classification Search

CPC ..... F21V 23/06; F21V 23/006; F21V 23/002; F21Y 2115/10; F21Y 2105/10

See application file for complete search history.

(56) References Cited

U.S. PATENT DOCUMENTS

2010/0090851 A1* 4/2010 Hauser ..... H01R 25/003 340/657
2017/0191642 A1* 7/2017 Xu ..... F21V 17/105

* cited by examiner

*Primary Examiner* — Sonji N Johnson
(74) *Attorney, Agent, or Firm* — Andrew F. Young, Esq.; Lackenbach Siegel, LLP

(57) ABSTRACT

The invention provides a wire clamping-type connection structure of a power supply and a light source board, which is in the field of lamp manufacturing. A wire clamping-type connection structure between a power supply and a light source board, comprises: a power supply and a light source board connected to the power supply via wires, and each one of the wire clamping grooves welded at one of power input points on the light source board, each of the plurality of threading holes arranged near the power input points on the edge of the light source board and each of the clamping pieces arranged on the plurality of threading holes.

8 Claims, 2 Drawing Sheets

WIRE CLAMPING-TYPE CONNECTION STRUCTURE BETWEEN POWER SUPPLY AND LIGHT SOURCE BOARD

CROSS-REFERENCE TO RELATED APPLICATIONS

The present application claims priority to and the benefit of Chinese Patent Application No. CN 201710026232.8, filed on Jan. 13, 2017, the entire content of which is incorporated herein by reference.

BACKGROUND OF THE INVENTION

1. Field of the Invention

The invention relates to the field of lamp manufacturing, more specifically, to a wire clamping-type connection structure between a power supply and a light source board.

2. Description of the Related Art

With the popularity of electrical energy, electrical products have been developed. Due to the superior lighting performance, the lamps have been an indispensable tool in people's lives.

Lamps include LED (Light Emitting Diode) lights which are used widely; because of its long life, high brightness, short response time and high security, LED lamp products have been increased.

When the traditional LED lights are assembled, the connection between the power supply and the light source is implemented by using the wire to be welded directly to the light source board. Two or four points of the power access welding joints are preset in the light source board, then the power supply wires are welded on the light source board through the soldering process to complete the product assembly. And the welding process adopts a manual welding, but it is difficult to control the amount of soldering during the manual welding, excessive amount of soldering may easily lead to short circuit between electronic devices; little amount of soldering will cause unsoldering, bubbles, pinholes and other problems. The manual welding is also likely to cause false soldering, empty soldering and other problems, leading to the circuit block and affecting product quality and security. The manual welding process is difficult to meet the requirements of automatic and semi-automatic production, which leads to the low production efficiency.

In summary, the present connecting of the LED lights has the issues that the welding quality is poor, the production efficiency is and the security is low.

SUMMARY OF THE INVENTION

In view of the above problems in the prior art, a wire clamping-type connection structure of a power supply and a light source board is provided. Wire clamping grooves are arranged on the light source board, and one of the wire clamping grooves is welded to the power input points. One of the wires on the power supply is clamped into one of the wire clamping grooves to achieve the quick connection between the power supply and the light source board. The production efficiency is improved without too much welding, the problem that the welding quality is poor and the security is low is avoided.

Detailed descriptions of the invention are as follows:

A wire clamping-type connection structure between a power supply and a light source board, comprising: a light source board, a power supply, wires and wire clamping grooves. The light source board is disposed opposite to the power source, and each one of power supply input points on the light source board is welded with one of the wire clamping grooves. One of the wires on the power supply is arranged on one of the wire clamping grooves through the light source board, and one of the wires connects the power supply to the light source board.

The above wire clamping-type connection structure between a power supply and a light source board, wherein the wire clamping grooves are made of conductive metal material.

The above wire clamping-type connection structure between a power supply and a light source board, wherein one of the wire clamping grooves has a side profile having a "U" shape, and a bottom of one of the wire clamping grooves is welded to one of the power supply input points of the light source board.

The above wire clamping-type connection structure between a power supply and a light source board, wherein one of the wire clamping grooves has two side walls in the shape of Chinese character "个", and in a middle of both side walls of one of the wire clamping grooves is provided with a groove which is a sub wire clamping groove.

The above wire clamping-type connection structure between a power supply and a light source board, wherein the sub wire clamping groove has a side profile having a "Y" shape, and an upper groove width of the sub wire clamping groove is wider than a lower groove width of the sub wire clamping groove, and the upper groove width is linearly reduced in a direction from a side away from the light source board to a side adjacent to the light source board.

The above wire clamping-type connection structure between a power supply and a light source board, wherein one of the wires has an exposed portion, a width of the sub wire clamping groove is equal to a width of the exposed portion of one of the wires.

The above wire clamping-type connection structure between a power supply and a light source board, wherein a plurality of threading holes are arranged on the edge of the light source board, and each one of the plurality of threading holes is arranged near one of the power supply input points.

The above wire clamping-type connection structure between a power supply and a light source board, wherein the plurality of threading holes are semi-circular holes, and clamping pieces are arranged on the light source board, and one of the clamping pieces is arranged on the plurality of threading holes.

The above wire clamping-type connection structure between a power supply and a light source board, wherein one of the clamping pieces is a movable piece. Each one of the clamping pieces is connected to an elastic element, and the elastic element is fixed to the light source board opposite to one end of one of the clamping pieces. In the initial state, one of the clamping pieces blocks the plurality of threading hole.

The above wire clamping-type connection structure between a power supply and a light source board, wherein one side of one of the clamping pieces opposite to the elastic element is provided with an are groove, and a size of the arc groove is no less than an outer diameter of the wire.

The positive effects of the above technical solution are: 1. by setting the wire clamping grooves on the light source board, the process of connecting the wires of the power supply to the light source board is simplified, and it is more adaptable for automatic and semi-automatic production and improves the efficiency; 2. one of the wire clamping groove includes a "U"-shaped groove and "Y"-shaped sub wire clamping groove which are on the both sides, by setting a plurality of grooves for winding, the fixing effects is well and it facilitates the wires to be clamped; 3. a plurality of threading holes are arranged on the light source board, and one of the plurality of threading holes are arranged near the wire clamping groove so as to facilitate the connection between the wires on the power supply and the wire clamping grooves through the light source board; 4. one of the clamping pieces is arranged in the plurality of threading holes to ensure that the wire can be clamped in the plurality of threading holes after it passes through the plurality of threading holes, so as to prevent the wire from sliding and affecting the connection with the wire clamping grooves, which causes the problem of poor contact; 5. one of the clamping pieces is provided with an arc groove to limit wires in the arc groove and fix the wires to the light source board further.

BRIEF DESCRIPTIONS OF THE DRAWINGS

The accompanying drawings, together with the specification, illustrate exemplary embodiments of the present disclosure, and, together with the description, serve to explain the principles of the present invention.

Figure 1:
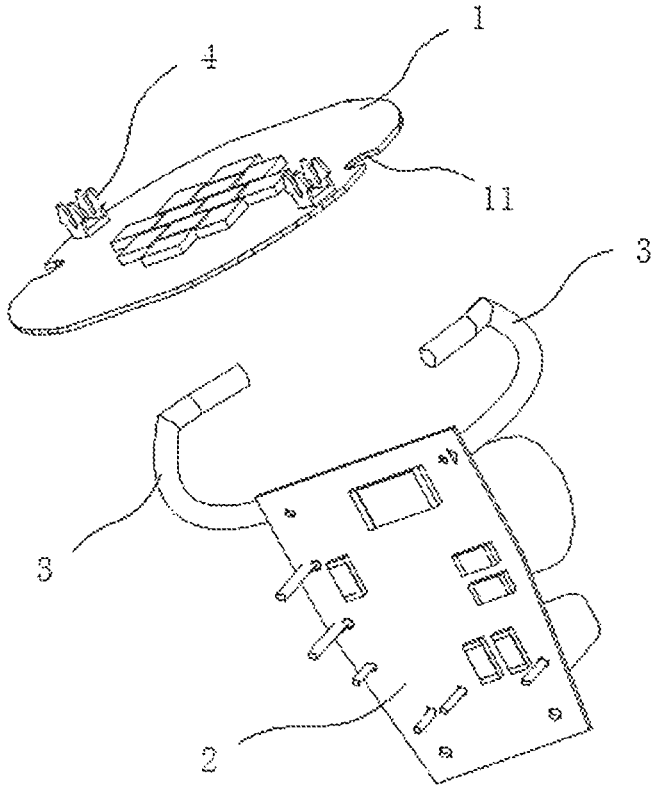
FIG. 1 is a structure diagram of the embodiment of a wire clamping-type connection structure between a power supply and a light source board according to the invention.

In the drawing: 1. light source board 11. threading hole 2. power supply 3. wire 4. wire clamping groove 41. sub wire clamping groove 5. clamping piece 51. elastic element 52. arc groove

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

Figure 2:
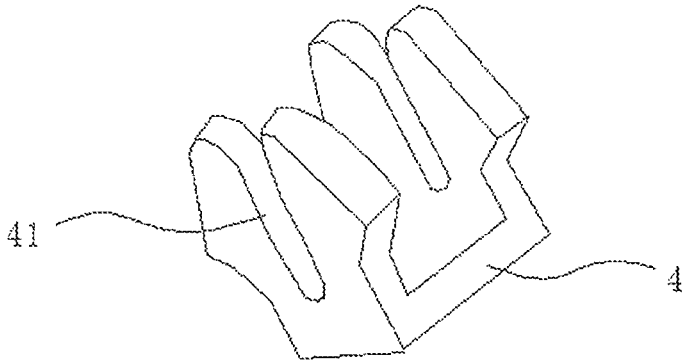
FIG. 2 is a structure diagram between a preferred embodiment of the wire clamping groove according to the invention.
Figure 3:
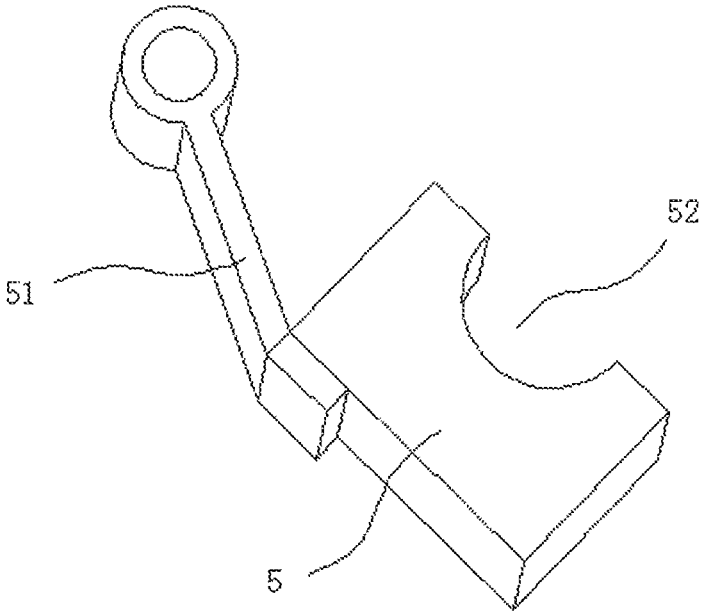
FIG. 3 is a structure diagram between a preferred embodiment of the clamping piece according to the invention.

FIG. 1 is a structure diagram of the embodiment of a wire clamping-type connection structure between a power supply and a light source board in the invention; FIG. 2 is a structure diagram of a preferred embodiment of the wire clamping grooves in the invention; FIG. 3 is a structure diagram of a preferred embodiment of the clamping pieces in the invention. As shown in the FIG. 1, FIG. 2 and FIG. 3, the wire clamping-type connection structure between a power supply and a light source board provided by the embodiment includes: the light source board 1, the threading hole 11, the power supply 2, the wire 3, the wire clamping groove 4 and the sub wire clamping groove 41, the clamping piece 5, the elastic element 51 and the arc groove 52.

Specifically, the power supply 2 is arranged opposite to the light source board 1, and the light source board 1 is arranged on the structural parts (not shown) such as the heat-conducting plate of the lamp, and the power supply 2 is connected to the light source board 1 through the wires 3.

Specifically, the light source board 1 is provided with a plurality of power supply input points, and several threading holes 11 are arranged near the power supply input point and on the edge of the light source board 1 so that the passed wires 3 are closer to the power supply input points. The threading hole 11 is a semicircular hole, so that the wire 3 is clamped into the threading hole 11 directly from the edge of the light source board 1 to implement the initial fixing of the wire 3.

Specifically, a wire clamping groove 4 is welded to each one of the power supply input points of the light source board 1. The overall shape of one of the wire clamping grooves 4 is arranged as U-shape, and the U-shaped bottom of one of the wire clamping grooves 4 is welded to the power supply input point.

The shape of both side walls of one of the wire clamping grooves 4 is arranged as big end up. The upper part is approximately triangular, and the lower part is rectangular. The long side of the upper part is connected with the lower part. The overall shape of the one of wire clamping grooves is arranged as approximately Chinese character "个", and the grooves with a side surface of the approximately Y-shape are arranged respectively in the middle of both side walls to form two sub wire clamping grooves 41. The upper groove width of one of the sub wire clamping grooves 41 is wider than the lower groove width of one of the sub wire clamping grooves 41, and the upper groove width is linearly reduced in a direction from the side away from the light source board 1 to the side adjacent to the light source board 1 to facilitate the clamping of the wire 3. By setting a plurality of grooves for winding, the wire 3 is ensured to be wound on the wire clamping grooves 4 as much as possible so that the clamping of the wire 3 is more secure.

One of the wire clamping grooves 4 is provided on each one of the power supply input points on the light source board 1 so that the wire 3 is arranged on the light source board 1, which avoids the problem that the wires 3 being directly welded on the light source board 1 causes the poor-quality welding. The device prevents the poor contact, simplifies the connection process, it adapts to the automatic and semi-automatic production, and effectively improves the production efficiency.

Specifically, one of the clamping pieces 5 is arranged on the light source board 1 at each one of the threading holes 11, one of the clamping pieces 5 is arranged on the side of the light source board 1 opposite to the wire clamping groove 4, and in the initial state, one of the clamping pieces 5 blocks the threading hole 11, effectively preventing the wire 3 from sliding and affecting the connection with the wire clamping grooves 4, which cause a problem of poor contact.

More specifically, one of the clamping pieces 5 is a movable piece, and one end of one of the clamping piece 5 is connected to the elastic element 51 which controls the movement of the one of the clamping pieces 5. The wire 3 is clamped into the threading hole 11 by moving one of the clamping pieces 5, and one of the clamping pieces 5 is rested on the wire 3 by the elastic element 51 to fix the wire 3 further.

More specifically, one end of the elastic element 51 connected to the clamping piece 5 is connected to the light source board 1, and the other end of the elastic element 51 is connected to one of the clamping pieces 5 and is provided with an arc groove 52 on the side opposite to the elastic element 51. The size of the arc groove 52 is no less than the outer diameter of one of the wires 3 so that one of the wires 3 can be completely pressed into one of the plurality of threading holes 11 by one of the clamping pieces 5, to ensure the relative fixing of the wires 3 and the light source board 1.

As a preferred embodiment, the width of the groove on the sub wire clamping groove 41 is equal to the width of the exposed portion of the wire 3, ensuring that the conductive portion of one of the wires 3 is completely clamped into the groove, and improving the stability of the wires 3.

As a preferred embodiment, a fuse is provided between the bottom of one of the wire clamping grooves 4 and the power input point on the light source board 1, ensuring that the device can automatically cut off the circuit when the lamp fails, and improving the safety effectively.

The wire clamping-type connection structure between the power supply and the light source board provided by the present embodiment comprises the power supply 2 and the light source board 1 connected to the power supply 2 through the wires 3. One of the wire clamping grooves 4 is welded to each one of the power supply input points on the light source board 1 and a plurality of threading holes 11 is arranged near one of the power supply input points on the edge of the light source board 1, and one of the clamping pieces 5 is arranged on the threading hole 11. One of the wire clamping grooves 4 is welded to each one of the power supply input points on the light source board 1, and the sub wire clamping grooves 41 are provided on both side walls of the wire clamping groove 4 so that one of the wires 3 is firmly clamped to one of the wire clamping grooves 4, to make the fixing effect better and simplify the connection process of the wire 3. It is more suitable for the automatic or semi-automatic production and improves the production efficiency. By setting the plurality of threading holes 11, the wires 3 are easy to pass and they further simplifies the connection process of the wires 3. By setting the clamping pieces 5, the sliding of one of the wires 3 is prevented and the connection effect is not affected, and a fuse is arranged in the wire clamping groove 4 to make the security higher.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A wire clamping-type connection structure between a power supply and a light source board, comprising: a light source board, a power supply, wires and wire clamping grooves, the light source board is disposed opposite to the power source, and each one of power supply input points on the light source board is welded with one of the wire clamping grooves, one of the wires on the power supply is arranged on the one of the wire clamping grooves through the light source board, and the wires connects the power supply to the light source board;

wherein the one of the wire clamping grooves has a side profile having a "U" shape, and a bottom of each one of the wire clamping grooves is welded to one of the power supply input points of the light source board; and wherein both side walls of each one of the wire clamping grooves is in the shape of Chinese character "个", and in middle of each of the side walls of each of the wire clamping grooves is provided with a sub wire clamping groove.

2. The wire clamping-type connection structure between a power supply and a light source board according to claim 1, wherein the wire clamping grooves are made of conductive metal material.

3. The wire clamping-type connection structure between a power supply and a light source board according to claim 1, wherein a side profile of the sub wire clamping groove is "Y" shape, and a width of an upper portion of the sub wire clamping groove is greater than a width of a lower portion of the sub wire clamping groove, and the width of the upper portion of the sub wire clamping groove is linearly reduced along a direction from a side away from the light source board to a side adjacent to the light source board.

4. The wire clamping-type connection structure between a power supply and a light source board according to claim 3, wherein each one of the wires has an exposed portion, the width of the lower portion of the sub wire clamping groove is equal to a width of the exposed portion of the wire.

5. The wire clamping-type connection structure between a power supply and a light source board according to claim 1, wherein a plurality of threading holes are arranged on the edge of the light source board, and each one of the plurality of threading holes is arranged near one of the power supply input points.

6. The wire clamping-type connection structure between a power supply and a light source board according to claim 5, wherein the plurality of threading holes are semi-circular holes, and clamping pieces are arranged on the light source board, and one of the clamping pieces is arranged on one of the plurality of threading holes.

7. The wire clamping-type connection structure between a power supply and a light source board according to claim 6, wherein the clamping pieces are movable pieces, each of the clamping pieces is connected to a elastic element, and the elastic element is fixed to the light source board opposite to one end of one of the clamping pieces, in an initial state, one of the clamping pieces blocks one of the plurality of threading holes.

8. The wire clamping-type connection structure between a power supply and a light source board according to claim 7, wherein one side of each of the clamping pieces opposite to the elastic element is provided with an arc groove, and a size of the arc groove is no less than an outer diameter of the wire.

* * * * *